US010905269B2

(12) United States Patent
Johansson

(10) Patent No.: US 10,905,269 B2
(45) Date of Patent: Feb. 2, 2021

(54) TRAVEL CLOTHES HANGER

(71) Applicant: Ronald Carl Johansson, Stillwater, MN (US)

(72) Inventor: Ronald Carl Johansson, Stillwater, MN (US)

( * ) Notice: Subject to any disclaimer, the term of this patent is extended or adjusted under 35 U.S.C. 154(b) by 0 days.

(21) Appl. No.: 16/551,426

(22) Filed: Aug. 26, 2019

(65) Prior Publication Data

US 2019/0380522 A1 Dec. 19, 2019

Related U.S. Application Data

(63) Continuation-in-part of application No. PCT/US2019/025307, filed on Apr. 2, 2019.

(60) Provisional application No. 62/653,763, filed on Apr. 6, 2018.

(51) Int. Cl.
*A47G 25/38* (2006.01)
*A47G 25/40* (2006.01)

(52) U.S. Cl.
CPC ..... *A47G 25/38* (2013.01); *A47G 25/40* (2013.01)

(58) Field of Classification Search
CPC ..... A47G 25/32; A47G 25/38; A47G 25/40
USPC ..... 223/DIG. 4
See application file for complete search history.

(56) References Cited

U.S. PATENT DOCUMENTS 1,674,043 A * 6/1928 Hoffman ..... A47G 25/20 223/91
2,122,617 A * 7/1938 Marshall ..... A47G 25/14 223/92
2,489,492 A 11/1949 Kleber
2,977,001 A * 3/1961 Vitale ..... D06F 57/125 211/113
2,997,217 A 8/1961 Levy
3,870,206 A 3/1975 Feinberg
3,958,696 A * 5/1976 Leonas ..... B42D 17/00 211/45
4,063,670 A 12/1977 Faarbech
4,168,791 A 9/1979 Clark, Jr.
4,438,874 A * 3/1984 Zuckerman ..... A47G 25/16 223/88
4,932,571 A 6/1990 Blanchard
5,085,357 A 2/1992 Chen
5,383,588 A 1/1995 Kazel
5,857,597 A 1/1999 Kolton
(Continued)

FOREIGN PATENT DOCUMENTS

JP 10179366 A * 7/1998

*Primary Examiner* — Nathan E Durham
(74) *Attorney, Agent, or Firm* — Kirk A. Buhler; Buhler & Associates Patenting

(57) ABSTRACT

The present invention provides a garment hanger intended to be packed into a suitcase with shirts left on the hangers. The clothes hanger has a hook section that is substantially C-shaped to hang on a closet rod or other means. The body portion is generally triangular for holding a shirt or other garment. The hook and hanger sections are spaced apart and connected by the flexible/strap section. The arms of the shirts can be folded across the front of the shirts on top of the hanger section. The shirts is folded again from the bottom. The flexible section is folded about 180 degrees to place the hook portion on top of the hanging portion with the bend in the flexible section even with the top of the triangular hanging section and if a shirt is on the hanger, even with the collar of the shirt.

12 Claims, 7 Drawing Sheets

(56) References Cited

U.S. PATENT DOCUMENTS

| | | | | |
|---|---|---|---|---|
| D405,965 | S * | 2/1999 | Cardenas | D6/328 |
| 5,957,345 | A * | 9/1999 | Petrou | A47G 25/483 223/91 |
| 6,264,077 | B1 * | 7/2001 | Kolton | A47G 25/743 223/87 |
| 6,293,443 | B1 | 9/2001 | Nykoluk | |
| 6,497,347 | B1 * | 12/2002 | Feibelman | A47G 25/743 223/85 |
| 9,392,897 | B2 | 7/2016 | Howsey | |
| D769,005 | S * | 10/2016 | Kay | D6/319 |
| 9,687,099 | B2 | 6/2017 | Snow | |
| D814,199 | S | 4/2018 | Ho | |
| 10,855,295 | B2 | 12/2020 | Fackenthal et al. | |
| 2003/0019892 | A1 * | 1/2003 | Giampavolo | A47G 25/1457 223/87 |
| 2005/0109802 | A1 * | 5/2005 | Avery | A47F 5/0006 223/85 |
| 2007/0119881 | A1 * | 5/2007 | Murphy | A47G 25/743 223/97 |
| 2007/0158375 | A1 * | 7/2007 | Yau | A47G 25/183 223/85 |
| 2008/0010787 | A1 * | 1/2008 | Kinskey | A45F 5/02 24/298 |
| 2014/0151411 | A1 * | 6/2014 | Anderson | A47G 25/08 223/88 |
| 2015/0157155 | A1 | 6/2015 | Howsey | |

* cited by examiner

TRAVEL CLOTHES HANGER

CROSS REFERENCE TO RELATED APPLICATION

This application claims the benefit International application PCT/US19/25307 filed Apr. 4, 2019 that claims the benefit of Provisional Application Ser. No. 62/653,763 filed Apr. 6, 2018 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in clothes hangers. More particularly, the present travel clothes hanger creates a clothes hanger where clothes can be placed onto the hanger, the hanger rod hook folded and the hanger with the clothes attached can be placed into luggage.

Description of Related Art Including Information Disclosed Under 37 CFR 1.97 and 1.98

Clothes hangers are generally triangular in shape and have a hook shape at the top to hang from a bar or rod. When packing shirts into suitcases they generally have to be removed from the hangers because the hook portion extends well above the shirt collar and therefore the shirts cannot be folded compactly unless removed from the hanger. There have been many attempts to solve this problem by having the hook portion removable or hinged. Although this will make the hanger more compact, it takes a great deal of time to individually fold or remove the hooks and they must be reinstalled or bent back into position individually when being removed from a suitcase to rehang. This can be particularly difficult because the attachment point of the hooks is generally inside the collar of the shirts. Further, the individual folding of shirts creates sharp creases which become wrinkles when the shirts are once again opened and hung.

When people travel, they will typically remove clothes from hangers, fold the clothes and then place the folded clothes into a suitcase. When they arrive at their destination, they will remove the folded clothes and hang the clothes onto hangers that "may" exist at the hotel. This creates a number of additional steps for transporting clothing. Another option is to take clothes and the hangers from a closet and place the hanger and clothes into a suitcase. The problem is that the hook of the hanger extends beyond the top of the clothing and requires additional space in the suitcase.

A number of patents and or publications have been made to address these issues. Exemplary examples of patents and or publication that try to address this/these problem(s) are identified and discussed below.

U.S. Pat. No. 3,870,206 issued on Mar. 11, 1975 to Irvin Feinberg and is titled Garment Hanger Frame Having a Hinged Hook. This patent discloses a garment hanger or the like is molded of plastic material to provide a substantially rigid supporting frame and a substantially rigid hook hinged to the frame by a thin, flexible section of the plastic material. The hinge has an axis of rotation which extends substantially parallel to the plane of the supporting frame. The hook in this patent uses a plastic hinge that joins the hook to the hanger body.

U.S. Pat. No. 4,168,791 issued on Sep. 25, 1979 to Frank Clark Jr. and is titled Folding Hanger. This patent discloses a garment hanger having a skirt bar with shoulder supports extending upwardly and toward each other from each end of the bar, terminating in the post and a hook with a spherical boss on it and the lower end of its stein interchangeably received in a recess in the post so that the hook can be swung from a folded position between the shoulder members and bar to a vertical U-position with the stein parallel to the post. In this hanger the hook pivots from the body of the hanger but also does not allow the hook to fold over multiple stacked articles of clothing that are on hangers.

U.S. Pat. No. 4,932,571 issued on Jun. 12, 1990 to Russell O. Blanchard and is titled Foldable Garment Display Device. This patent discloses a folding hanger for displaying garments has a polygonal outer frame shaped to support a garment to which outer frame an inner garment supporting frame is pivotally secured by an integral hinge whereby the inner garment supporting frame can be pivoted from a storage position nested within the outer frame to a garment display position in which it depends from and below the outer frame. This patent does not include a flexible connection between the hanger and the hook that can be folded over the garment.

U.S. Pat. No. 5,085,357 issued Feb. 4, 1992 to Ken-Wang Chen and is titled Collapsible garment hanger with hook recess. This patent discloses a foldable hanger of the present invention mainly comprises a hook portion, a frame and two shoulders. The hook portion is formed with an extended cylindrical post at its lower portion, from which extends a notch from half way of the cylindrical post down to its bottom, and two flanges at its two sides of the notch. While the hook in this patent can collapse when the hook folds over the garment area in increases the height of the packing.

U.S. Pat. No. 9,392,897 issued on Jul. 19, 2016 to Justin Howsey and is titled Retractable Reeled Garment Hanger. This patent discloses a garment hanger having a hook portion and a body portion connected by a retractable reel having a spring-biased spool with a cord wound thereon. The hook is substantially C-shaped and is designed to be hung on a closet rod or other means. The body portion is substantially triangular and designed to hang clothes thereon. The cord includes a proximal end permanently attached to the spring-biased spool and a distal end attached to the upper portion of the body portion. The retractable reel is configured to extend, retract, and latch the cord in a desired length. While the cord can be extended to any length it does not maintain a parallel relationship between the hanger and the hook. Also, the reel mechanism is very bulky and would take a great deal of space if packed.

U.S. Pat. No. 9,687,099 that issued on Jun. 27, 2017 and is titled Collapsible hanger for use in-garment to reduce creasing, crushing, and wrinkling, while maintaining support, of upper garment during storage and transportation. This patent discloses a collapsible hanger includes a left arm, a right arm, and a hook. A hinge rotatably holds the left and right arms together. When in expanded state, the left and right arms extend opposite each other. When in collapsed state, the arms are rotated adjacent to each other. The hook is rotatably coupled to one of the arms, and rotatable between first and second positions.

What is needed is a travel clothes hanger with a flexible section that connects between the garment hanger and the hanging hook. The flexible section should allow for easy folding over one or multiple garments when stored in a suitcase and can be removed from the suitcase and hung on a hanger at a destination or in a home.

BRIEF SUMMARY OF THE INVENTION

The subject invention provided a clothes hanger that can pack a number of shirts at one time while still on their hangers. Another purpose of this invention is to provide a travel hanger with which shirts can be very quickly removed from a suitcase and re-hung. A third purpose of this invention is to provide a travel hanger which reduces the number and size of wrinkles in shirts when packed in a suitcase.

Unlike conventional hangers and attempts to make hangers more compact, this invention spaces the hook from the hanging section and connects the hook to the hanging section with a flexible section can be bent over the shirts and it will take up very little additional space above the collars of the shirts. Further, several shirts can be folded at one time and all of the flexible sections can be bent as a group and the hook sections placed on top of the shirts. The hooks are conveniently accessible to be grasped as a group and the shirts lifted from the suitcase as a group. A quick shake unfolds the arms and they fall to the normal hanging position to be hung up very quickly as a group.

It is an object of the travel clothes hanger to be used to hang clothes. A user can use the travel hanger to hang one or multiple articles of clothing onto the hanger. The hanger can be used to hang both shirts on the upper portion of the triangle and pants on the horizontal rod portion or a combination of both on the hanger. The configuration of the hanger allows for multiple articles of clothing on separate hanger packed at the same time.

It is an object of the travel clothes hanger to have a flexible connection between the rod hook hanging portion and the clothes triangle. The flexible connection can loop through an elongated opening in the bottom of the hook portion and through a complementary elongated opening in the top of the triangle portion of the hanger without a loop can be attached to the hook and hanging section by other means. The flexible connection can be formed using a variety of materials from fabrics or plastic. The hook and hanging sections hold the flexible connection and resist rotation of the clothes triangle relative to the rod hook. This also maintains the clothes triangle perpendicular to a clothes rod. Although the flexible section urges the hanging section toward the same plane as the hook section, the hook can be easily rotated out of the plane of the hanging section. This permits the hanger to be hung on a bar that is parallel to the hanging section. Such as a top dresser drawer pulled open just a bit, the hook can be rotated and hooked the drawer opening at an angle of about 30 degrees to the hanging section.

It is an object of the travel clothes hanger for the hook portion of the hanger to fold over one or a stack of clothing on the hanger. The flexible connection is an elongated member that provides a distance from the rod hook to the top of the hanger triangle. This distance allows the rod hook to flex and extend over one or a plurality of clothes that is/are placed on the clothes triangle.

It is another object of the travel clothes hanger for the body of the hanger to be fabricated as an injection molded or fabricated in plastic, cardboard, wood, stamped metal or equivalent material. A fabric or similar material connects the rod hook to the hanger triangle. Other embodiments are using a two-shot molding process where the hook and the hanger triangle or molded in one shot from a more rigid plastic and the second shot molds the connection between the two parts using a more flexible plastic or elastomer. Another embodiment is molding an elongated thin section between the rod hanger and the hanger triangle which may have holes or even thinner areas to add flexibility.

It is still another object of the travel clothes hanger to include clothes packing process where one or a plurality of articles of clothing are placed onto the hanger, folded, placed into a suitcase, transported and then hung onto a clothing rod without requiring the clothing to be removed from the travel clothes hanger.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
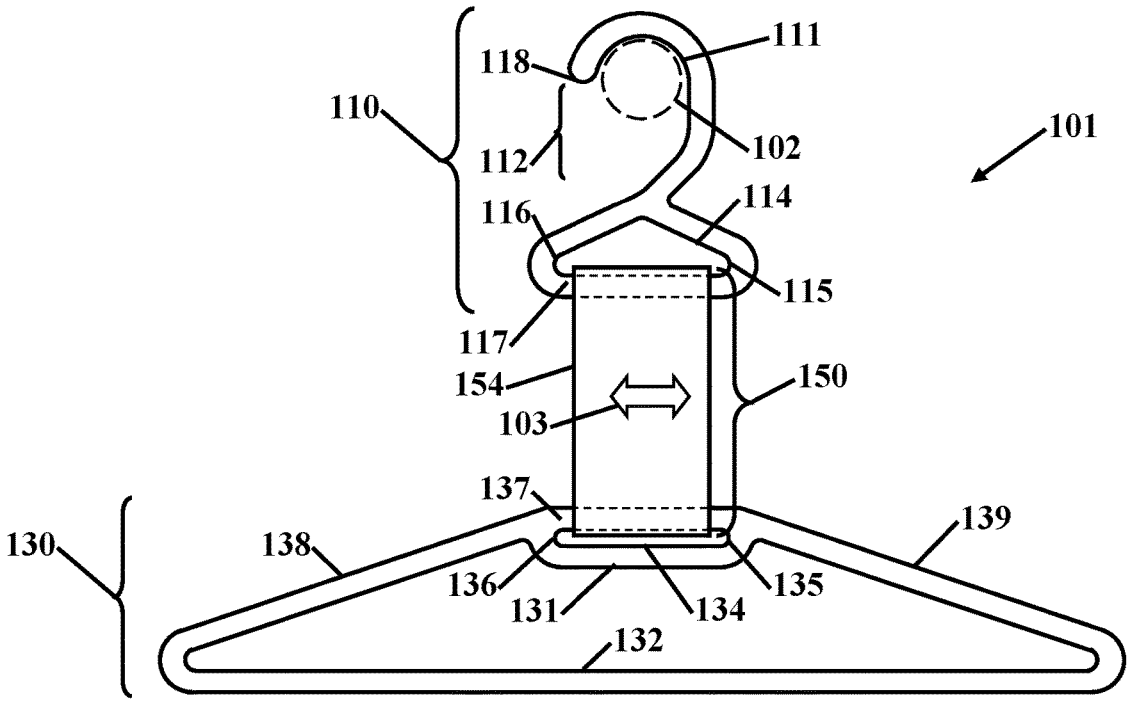
FIG. 1 shows a travel clothes hanger in a first embodiment.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

| Item Numbers and Description | |
|---|---|
| 101 travel hanger | 102 rod |
| 103 side-to-side | 104 shirt(s) |
| 105 suitcase | 107 sleeve(s) |
| 110 hook section | 111 hook |
| 112 hook opening | 114 opening |
| 115 first side stop | 116 second side stop |
| 117 upper flexible section arm | 118 tip |
| 126 arm opening | 127 first hook side arm |
| 128 second hook side arm | 130 hanger section |
| 131 lower keeper | 132 pants rod |
| 134 opening | 135 first side stop |
| 136 second side stop | 137 upper flexible section arm |
| 138 shoulder | 139 shoulder |
| 140 tab | 141 elongated ends |
| 142 holes | 143 recess |
| 144 pin | 145 offset |
| 146 arm opening | 147 first hanger side arm |
| 148 second hanger side arm | 150 flexible section |
| 151 cord flexible section | 152 living hinge |
| 153 holes | 154 flexible section |
| 155 cord | 156 single flexible section |
| 157 loop flexible section | 158 end cap |
| 159 multi-segment flexible section | 161 holes |
| 162 block | 165 hook section |
| 166 pointed posts | 167 cover |
| 170 flexible section | 171 holes |
| 175 flexible section | 180 hanger section |
| 181 holes | 182 block |
| 183 pins | 185 hanger section |
| 186 pointed posts | 187 cover |

FIG. 1 shows a travel clothes hanger 101 in a first embodiment. The travel clothes hanger 101 has a hook section 110, a hanger section 130 and a flexible section 150 connecting the hook section 110 to the hanger section 130. The different sections are described in more detail herein.

The hook section 110 has a hook 111 that is configured to hang the travel clothes hanger 101 on a rod 102 or other horizontal element like a clothes hook or door knob from the inside of the hook or on the tip 118 of the hook. The travel clothes hanger 101 can essentially be hung on anything that can pass though or into the hook opening 112. In this embodiment and opening 114 provides a clearance for the flexible section 154 in the flexible section 150. While the opening 114 is shown in a triangular configuration, other shapes are contemplated. The opening 114 has a first side 115 and a second side 116 where the flexible section 154 is centered on within the opening 114. The flexible section 154 is supported on the top of the upper flexible section arm 117 of the hook section 110.

The hanger section 130 has a complementary opening 134 for the flexible section 154. The opening 134 is formed by a lower keeper 131 and an upper flexible section arm 137. The flexible section 154 is constrained from side-to-side movement 103 by the first side stop 135 and the second side stop 136. In addition to holding shirts, coats or other items on the shoulders 138 and 139 of the hanger section 130. Pants, ties and other items can be hung on the horizontal pants rod 132. While the pants rod is shown in this embodiment, the pants rod can be eliminated.

Figure 2:
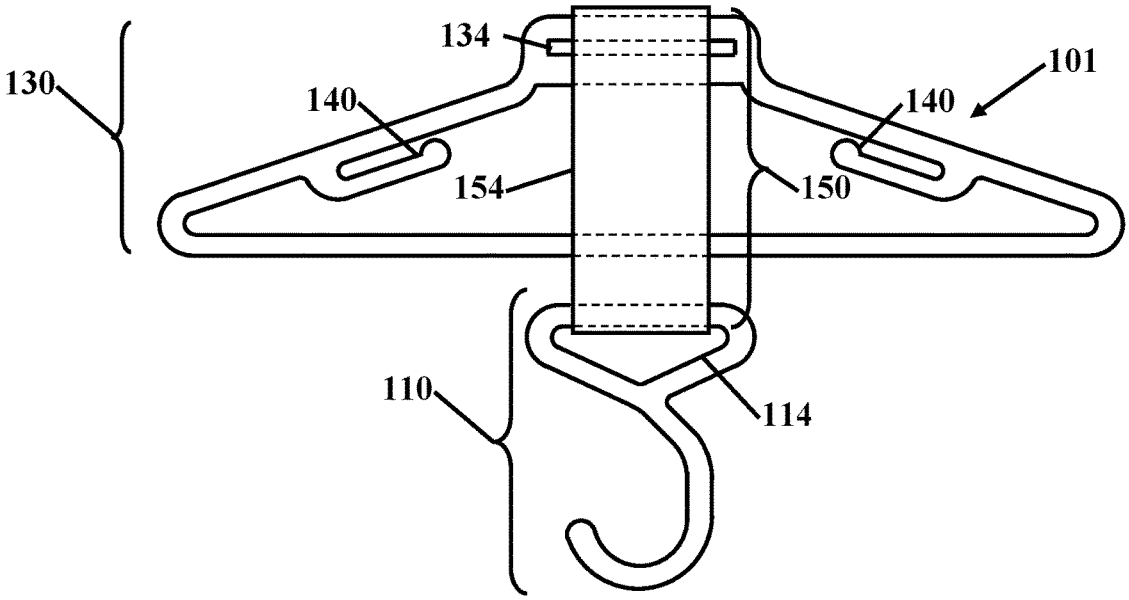
FIG. 2 shows an alternate embodiment of the travel clothes hanger with the rod hook section folded over.

FIG. 2 shows an alternate embodiment of the travel clothes hanger 101 with the rod hook section 110 folded over the same hanger with the flexible section 150 folded over the hanger section 130 and the hook section 110 laying across the hanger section. This variation has the same or similar openings 114 and 134 to retain the flexible section 154. In this embodiment the interior of the hanger section has tabs 140 to allow for retention of other items.

Figure 3:
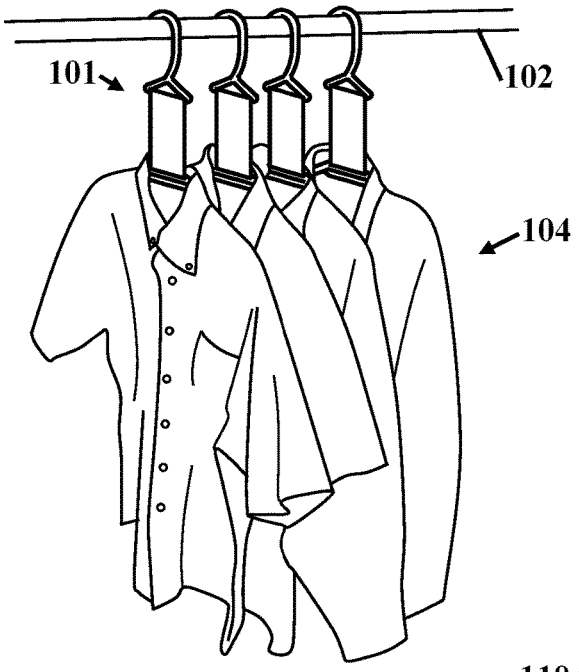
FIG. 3 shows a group of shirts each on a separate travel clothes hanger.

FIG. 3 shows a group of shirts 104 each on a separate travel clothes hangers 101 where the travel clothes hangers 101 are supported by the hooks which are in turn supported by a rod 102. Note that the distance from the rod 102 to the shirts 104 is greater than those of a typical clothes hanger. This is a typical configuration how people will hang clothes both at home and at a hotel or other location where clothing is hung on a rod.

Figure 4:
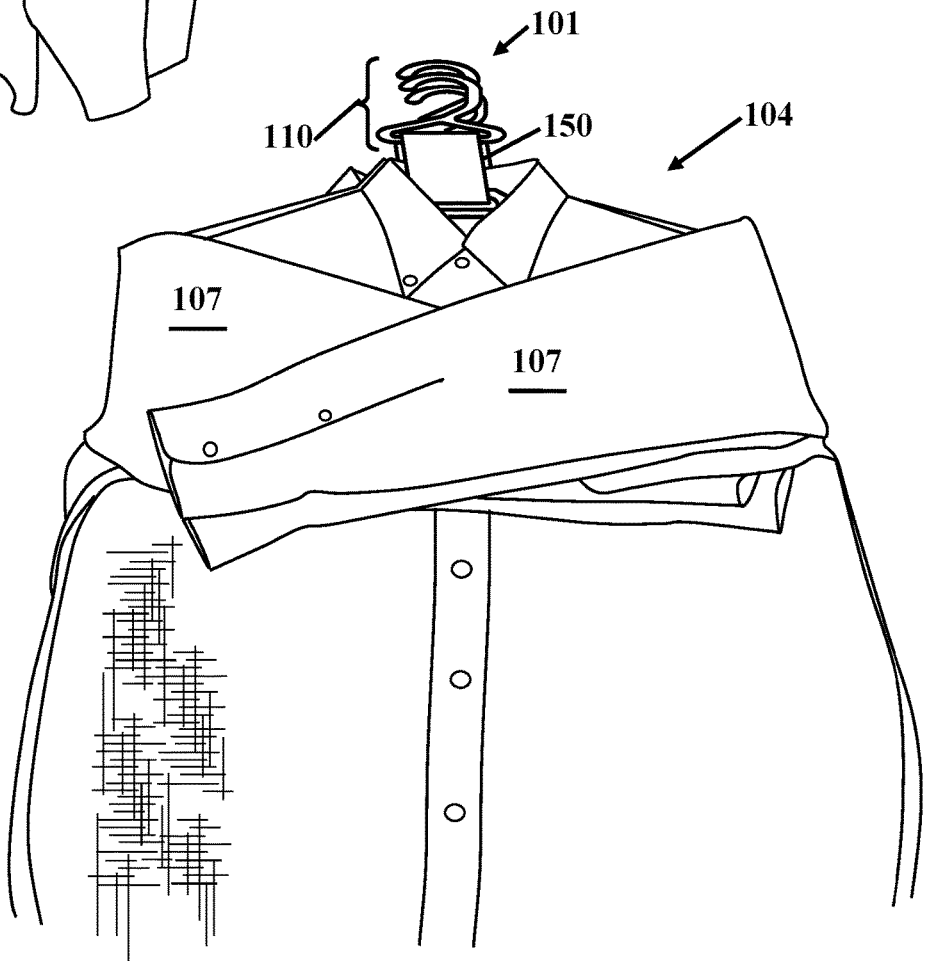
FIG. 4 shows the same shirts of FIG. 3 with both arms folded across the front of the shirts.

FIG. 4 shows the same shirts of FIG. 3 with both arm sleeves 107 of the shirt 104 collectively folded across the front of the shirts 104. This can be accomplished by removing the plurality of shirts 104 as a collective group and then folding each side of sleeves 107 as a collective group without requiring the sleeves of each shirt to be individually folded over its respective shirt.

Figure 5:
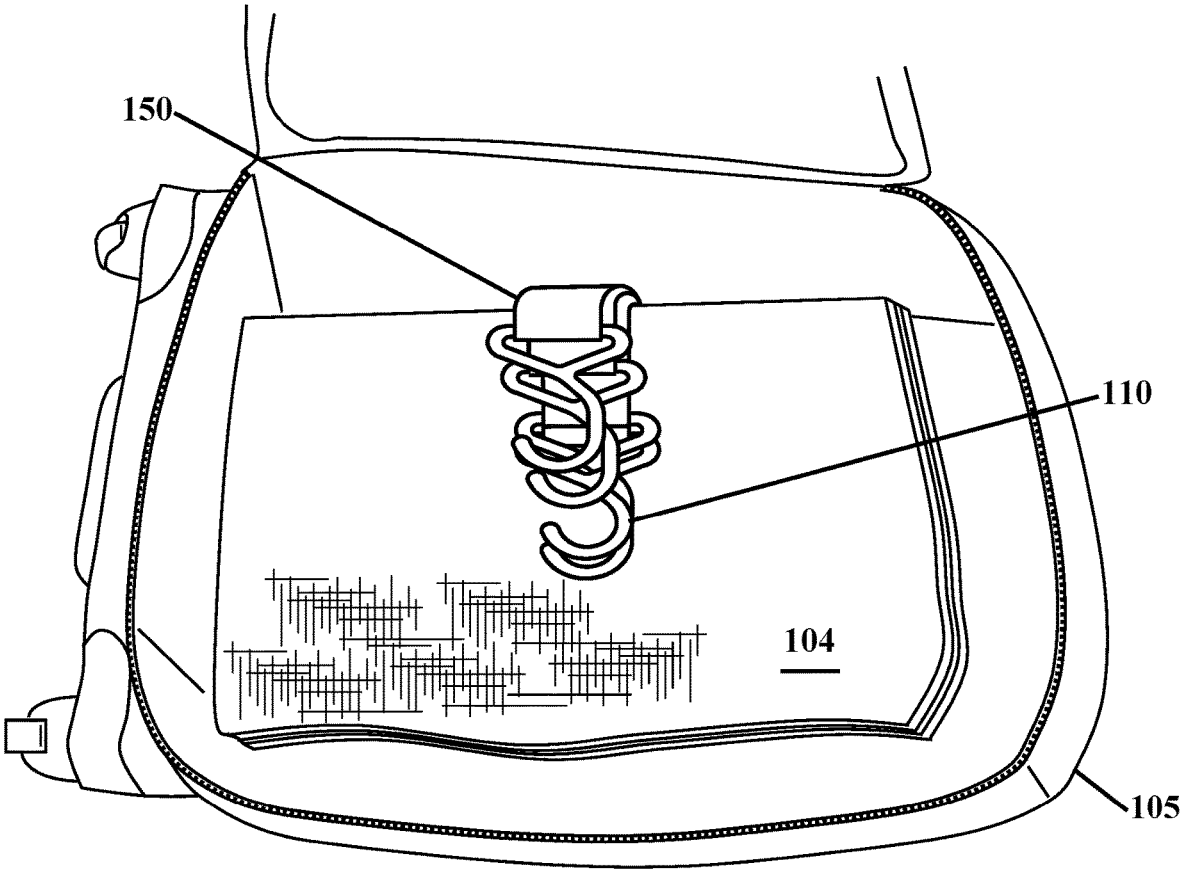
FIG. 5 shows the shirts in a suitcase with the rod hooks all placed over the stack of shirts.

FIG. 5 shows the shirts 104 in a suitcase 105 with the rod hooks 110 all placed over the stack of shirts 104. The stack of shirts 104 can be placed into a suitcase 105 as shown. Note that the hooks are all available to be grasped together to remove the stack of shirts 104 from the suitcase 105. In lifting the group of hooks 110, the shirts 104 will all fall open and are ready to be once again hung up.

Note that compared to folding shirts individually, the bends of the fabric have a much larger radius and will, therefore, be less wrinkled when they are taken out of the suitcase. To reduce the wrinkling further, a T-shirt can be added on top of the other shirts. This extra T-shirt will serve to create an even greater radius in the fabric folds and thereby create even fewer wrinkles.

Manufacturing Construction:

There are several possible construction options for the travel hangers of this invention. These construction options relate to the type of flexible section material and how the flexible section material is attached to the hook section and the hanger section.

Figure 6:
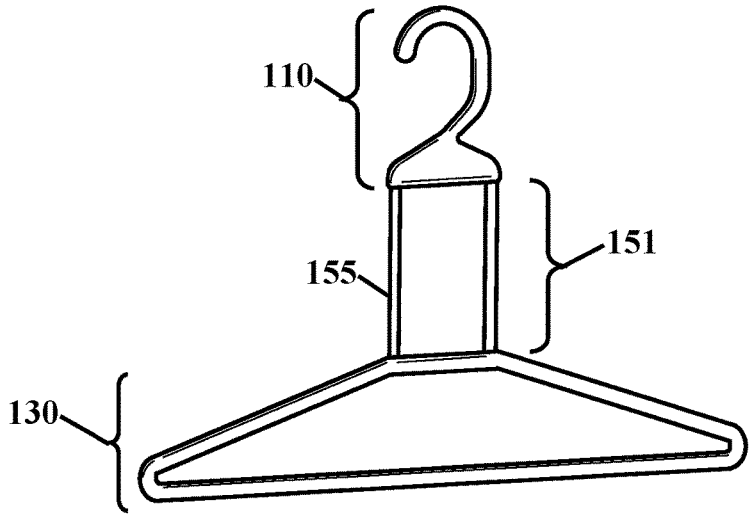
FIG. 6 shows a second embodiment of the travel clothes hanger.

FIG. 6 shows a second embodiment of the travel clothes hanger 101. In this embodiment there are at least two ropes, cords 155 or thin chain in the cord flexible section 151 that connect the hook section 110 and hanger section 130. The cord will bend easily in this embodiment but introduces a potential tangling of the cord(s) 155 and the hook section(s) 110.

Although it is not shown, it is also contemplated to use a single cented cord to connect the hook and hanger portions. The design would be less likely to tangle than a two-cord embodiment, however, it would lose the feature of keeping the hook and hanger sections in one plane which could result in clothes being hung and twisting at different angles and the rotation of a group of shirts twisting out of the desired hanger-hook plane when carrying them.

Figure 7:
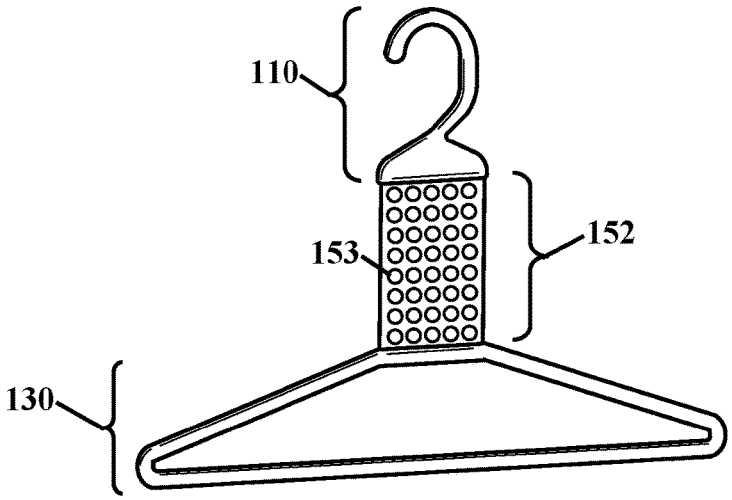
FIG. 7 shows a third embodiment of the travel clothes hanger.

FIG. 7 shows a third embodiment of the travel clothes hanger. In this embodiment the hook section 110, living hinge 152 flexible section, and hanger section 130 are molded as a single part. Here the flexible section is shown as a very thin part compared two the hook section 110 and hanger sections 130. In addition, many holes 153 have been added to make the flexible section as flexible as possible while still being the same material as the hook and hanger sections. In another embodiment the molded section has thin horizontal sections that are living hinges that permit easy bending of the flexible section at the hinge locations.

It is also contemplated that the travel clothes hanger can be fabricated in a "two-shot mold" where the hook section 110 and hanger section 130 are of one material and then the str flexible section ap section can be molded in a softer more flexible material such as a thermoplastic elastomer and have a finished travel hanger assembly as a completed product from one molding process. This could result in a very flexible section with more rigid hook and hanger sections being "assembled" in one molding operation.

Yet another contemplated variation is to insert mold a flexible section material. This will result in a complete assembly of the subject travel hanger as it comes out of the molding operation with a material such as cloth for the flexible section. This would be an attractive assembly because the flexible section material can "disappear" into the hook and hanger sections with no visible attachment means.

Figure 8:
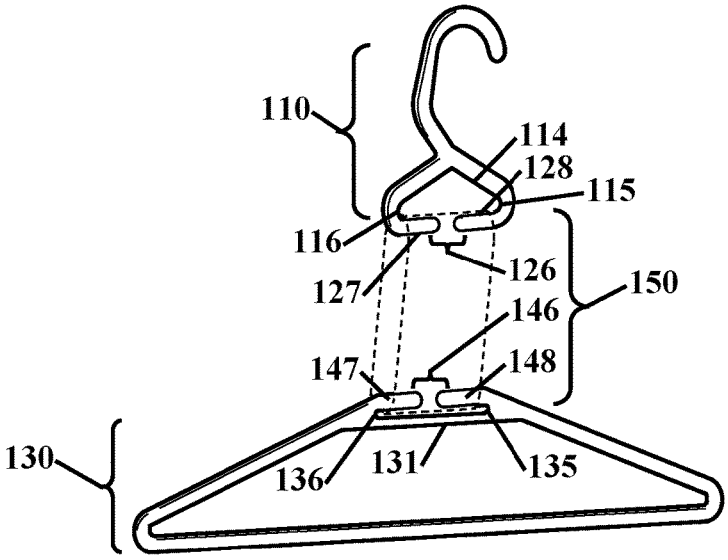
FIG. 8 shows a fourth embodiment of the travel clothes hanger.

FIG. 8 shows a fourth embodiment of the travel clothes hanger. The components are similar to previously disclosed embodiments with the exception of a slot 126 in the hook section 110 and a slot 146 in the hanger section 130. A loop flexible section (shown in broken lines) or a single layer flexible section that is sewn can pass through the slots 126 and 146 for assembling the hanger.

Figure 9:
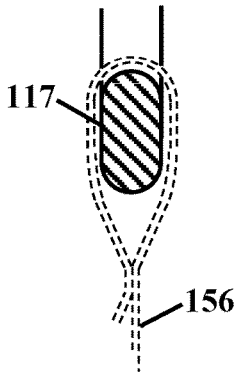
FIG. 9 shows a cross-section of the hanger using a single flexible section.

FIG. 9 shows a cross-section of the hanger using a single flexible section 156 passing over (or around) the upper flexible section arm 117. The upper flexible section arm 117 is shown as a shape but other shapes are contemplated such as, but not limited to flattened, round, rectangular, ellipse or radiused rectangular. The flexible section material 156 is a single layer (not a continuous loop) that has small loops sewn onto the ends. The loop is wrapped around flexible section arm 117, and equivalently to the arm in the hanger section (not shown). The flexible section material can be sewn into a loop, glued or with some material that is ultrasonically or heat welded to itself.

Figure 10:
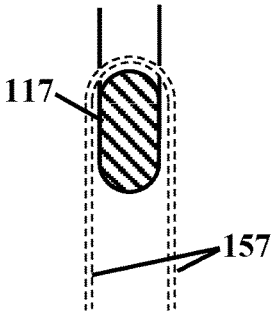
FIG. 10 shows a cross-section of the hanger using a loop flexible section.

FIG. 10 shows a cross-section of the hanger using a loop flexible section 157. In this construction the loop of flexible section material 157 can pass through a sewn circle of material and then assembled.

Figure 11:
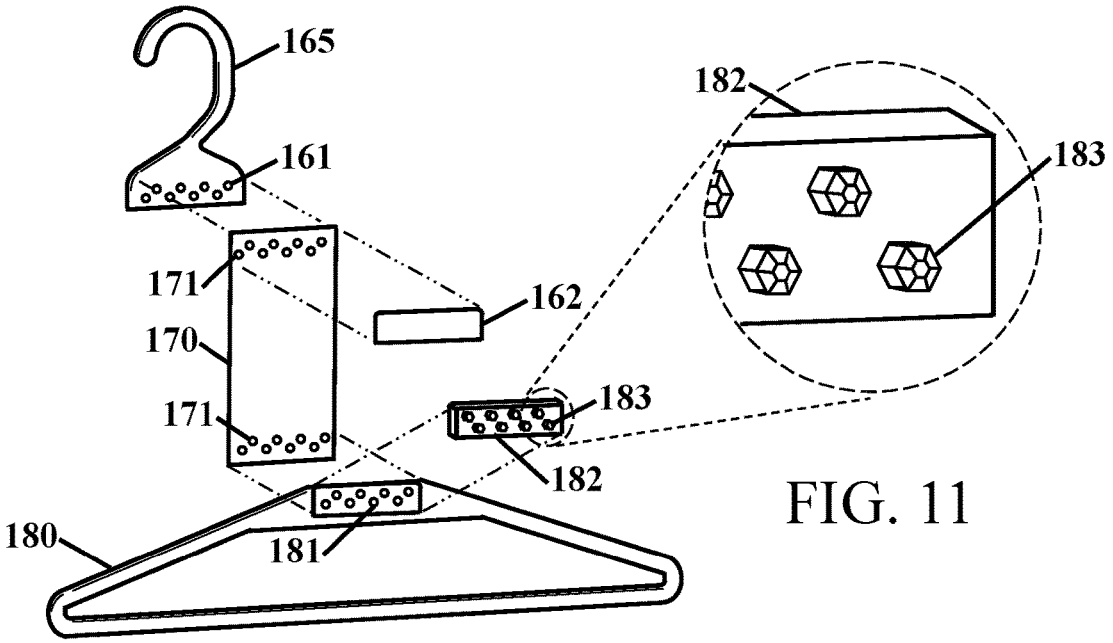
FIG. 11 shows a fifth embodiment of the travel clothes hanger.

FIG. 11 shows a fifth embodiment of the travel clothes hanger. This embodiment uses a plurality of holes 161 in the hook section 165, holes 171 in the flexible section 170 and holes 181 in the hanger section 180. Separate blocks 162 or 182 are shown, but they can both have the same configuration or be identical parts. The blocks have a plurality of posts 183 that are placed to correspond to the holes in the flexible section 170, hanger section 180 and hook sections 165. The posts 183 are shown as hexagonal, but other shapes such as round, square, triangular or multi-sided shapes that press fit the posts 183 in the block through the holes 171 in the flexible section and engage into the holes 161 and 181 in the hook section 165 and the hanger section 180 respectively. The blocks can alternatively be bonded, heat staked or ultrasonically welded onto the hook section 165 and the hanger section 180. The location of the holes and posts can be reversed from the orientation shown. Although not shown, the blocks could also be attached with screws, rivets or other fasteners.

Figure 12:
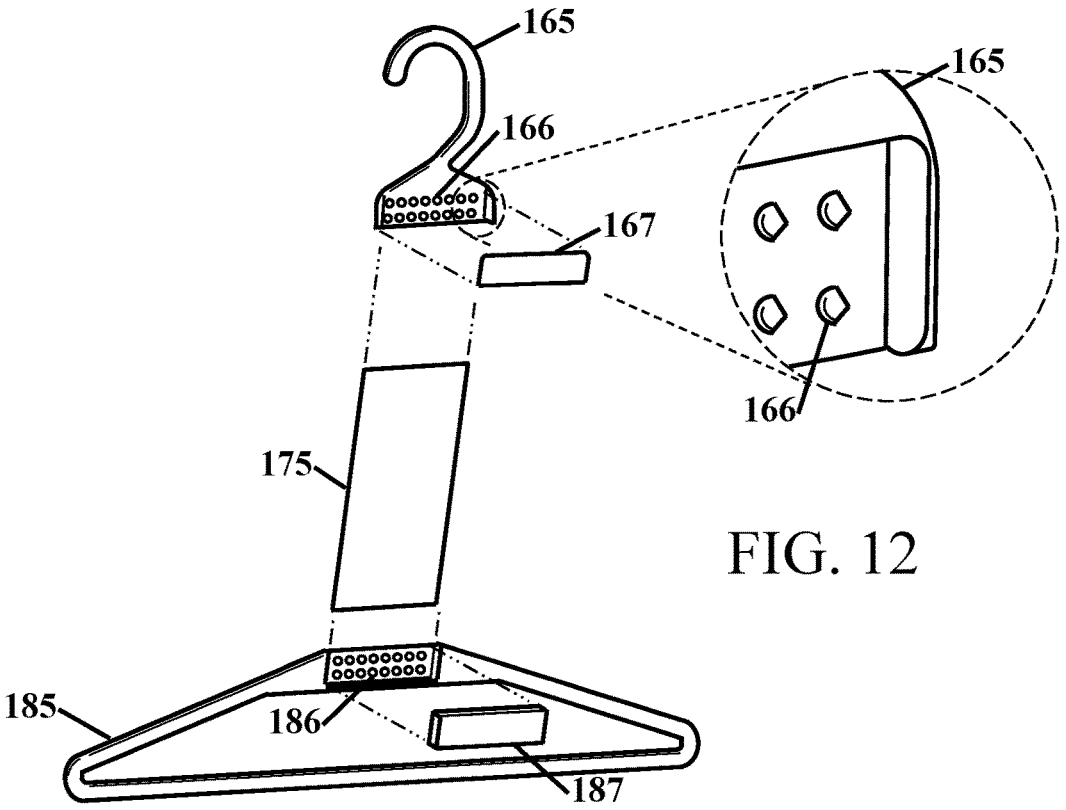
FIG. 12 shows a sixth embodiment of the travel clothes hanger.

FIG. 12 shows a sixth embodiment of the travel clothes hanger. This embodiment uses a plurality of pointed posts 166 in the hook section 165 and pointed posts 186 in the hanger section 185. Separate blocks 167 or 187 are shown, but they can both have the same configuration. The blocks have a plurality of pointed posts or be flat. The fabric (or other) flexible section material 175 in placed over the hook section 165 or the hanger section 185, the block placed over the flexible section 175 and ultrasonically welded or bonded to join the assembly together to make the travel clothes hanger. During the ultrasonic welding, the posts will melt through the flexible section material and bond to the block plastic, trapping the flexible section. If the flexible section material is a plastic, the flexible section may also melt and bond to the hook and hanger section. It is also contemplated that the flat and the post sides in this embodiment can also be revered.

Figure 13:
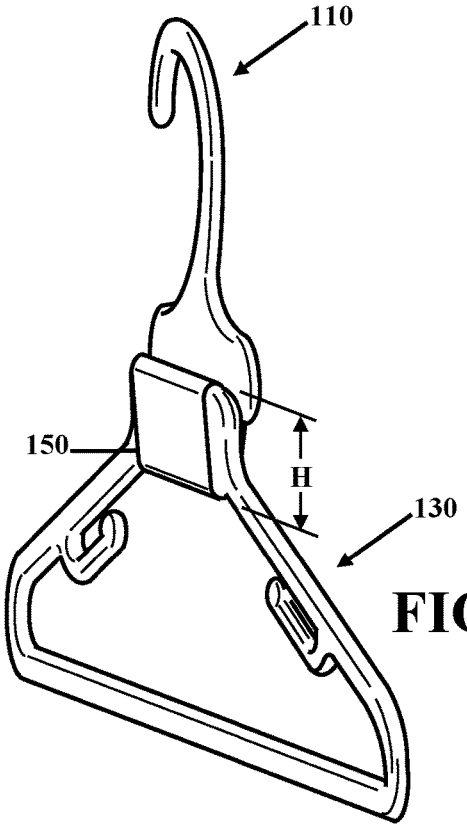
FIG. 13 shows a perspective view of the travel hanger with the flexible section wrapped around the top of the hanger section.
Figure 14:
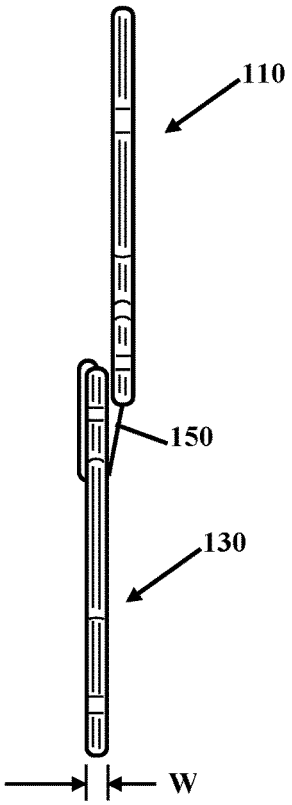
FIG. 14 shows a side view of the travel hanger from the previous view.

FIG. 13 shows a perspective view of the travel hanger with the hook section 110 wrapped around the top of the hanger section 130 and FIG. 14 shows a side view of the travel hanger from the previous view showing the flexible section 150 wrapping or passing through the triangular opening of the hanger section 130 and around the top of the hanger section 130. The top of the hanger section 130 has a height "H" and the hanger section 130 has a width "W". This configuration allows the overall height of the travel hanger to be essentially the same as a standard clothes hanger when the hook section 110 is wrapped around the top of the hanger section 130.

Figure 15:
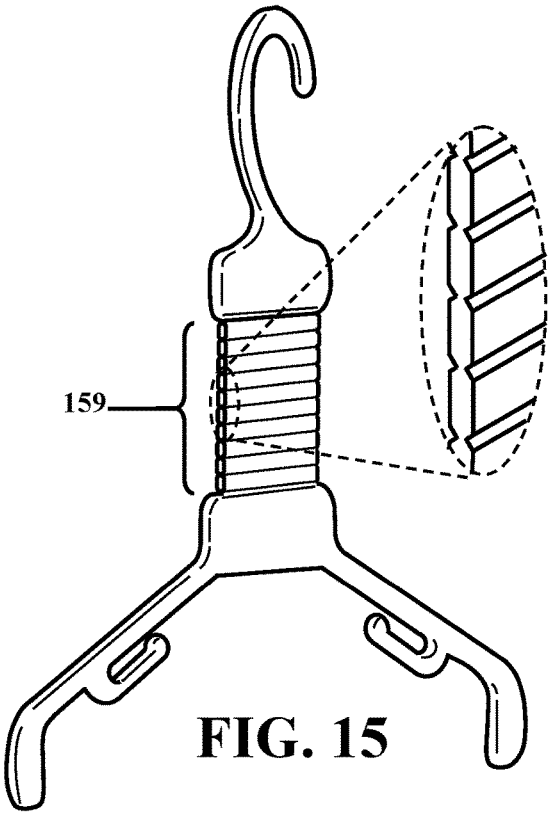
FIG. 15 shows the hanger section in an embodiment without a pants rod.

FIG. 15 shows the hanger section in an embodiment without a pants rod. In this figure the flexible segment 159 between the hanger and the hook is molded at the same time and of the same material as the hook and hanging section. The flexible section is formed by a series of very thin strips between multiple thicker segments. These very thin areas serve as "living hinges" and because there are several of them, the entire strip area is very flexible. Living hinges of this type are best manufactured with a polypropylene polymer.

Figure 16:
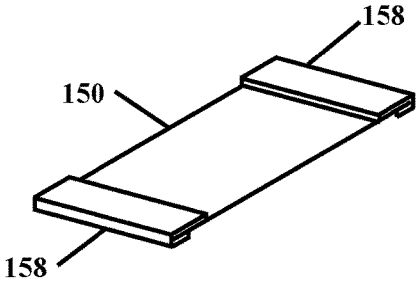
FIG. 16 shows a flexible section with end caps.

FIG. 16 shows a flexible section 150 with end caps 158. It is contemplated that the end caps 158 are insert molded onto the flexible section 150. This subassembly can then be slid or snapped into the hanger section and the hook section.

Figure 17:
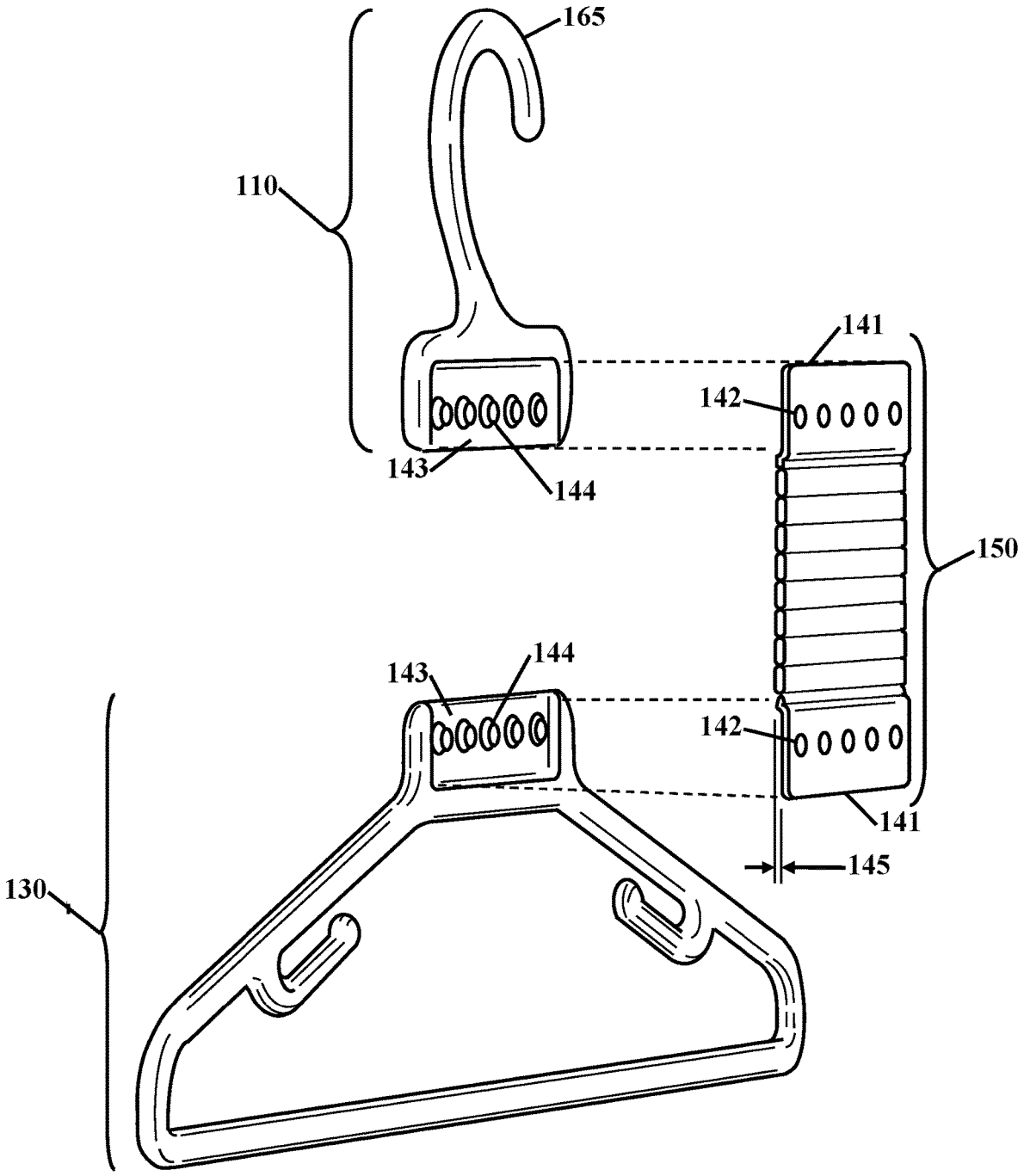
FIG. 17 shows a seventh embodiment of the travel clothes hanger.

FIG. 17 shows a seventh embodiment of the travel clothes hanger with the three elements of the hook section 110, hanger section 130 and with the flexible section 150 displaced. The flexible section 150 is similar construction with the multi-segment flexible section as shown and described in FIG. 15. The flexible section 150 has opposing elongated ends 141 with engaging feature holes 142. The hook section 110 and the hanger section 130 have recesses 143 with an outer wall that surrounds three sides of the recess 143. The outer wall helps to maintain and center the outer sides of the opposing elongated ends 141. The recesses 143 have a plurality of pins 144 that are configured to engage into the holes 142 of the opposing elongated ends 141 of the flexible section 150. The opposing elongated ends 141 of the flexible section 150 are offset 145 from the center of the flexible section to allow the flexible center section to be centered in the hook section 110 and the hanger section 130. The flexible section 150 is symmetric to allow either end of the flexible section 150 to engage into the recess 143 of either the hook section 110 or the hanger section 130.

Thus, specific embodiments of a travel clothes hanger have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A travel clothes hanger comprising:

a hook section;

a hanging section;

said hook section and said hanging section being spaced apart;

said hook section having a horizontal hook bar at a base of said hook section;

said hanging section having a horizontal hanging bar having a height and a width at a top of said hanging section;

said hook bar and said hanging bar connected by a flat flexible section having a fixed length between said hook bar and said hanging bar having a first embodiment that maintains a displaced parallel relationship between said hook section and said hanging section;

said fixed length being greater than said height plus two times said width;

said fixed length being less than two times said height plus two times said width;

said hanging section is open below said hanging bar and is configured for said hook section to wrap under and around said hanging bar to shorten said flat flexible section such that said hanging section contacts said hook section on a first side of said hook section while said flat flexible section wraps on a second side of said hanging section to maintain said parallel relationship between said hook section and said hanging section and reduce a distance between said hook section and said hanging section.

2. The travel clothes hanger of claim 1, wherein said flexible section is a cloth like material.

3. The travel clothes hanger of claim 1, wherein said flexible section is a plastic material.

4. The travel clothes hanger of claim 1, wherein said flexible section has at least two horizontally spaced holes that are located near an upper end of said flexible section and are configured to engage with at least two horizontally spaced posts on said hook section to connect said flexible section to said hook section and said flexible section has at least two horizontally spaced holes that are located near a lower end of said flexible section and are configured to engage with at least two horizontally spaced posts on said hanging section to connect said hanging section to said flexible section.

5. The travel clothes hanger of claim 4, wherein said at least two horizontally spaced holes are round holes.

6. The travel clothes hanger of claim 4, wherein said at least two horizontally spaced posts are round posts.

7. The travel clothes hanger of claim 1, wherein said hanging section further includes a pants rod or a strap hook.

8. The travel clothes hanger of claim 1, wherein said flexible section is a plastic part with mating features that are configured to engage with said hook section to retain said flexible section with said hook section.

9. The travel clothes hanger of claim 1, wherein said flexible section is a plastic part with mating features that are configured to engage with said hanging section to retain said flexible section with said hanging section.

10. The travel clothes hanger of claim 1, wherein said flexible section is configured to allow said hook section to fold beyond a bottom of said hanging section.

11. The travel clothes hanger of claim 1, whereby when said hook section is wrapped under and around said hanging bar, said hook section is offset from said hanging section by said width.

12. The travel clothes hanger of claim 1, whereby said flexible section is removable from both said hook section and said hanging section.

* * * * *